US005819604A

United States Patent [19]

Buck

[11] Patent Number: 5,819,604

[45] Date of Patent: Oct. 13, 1998

[54] INTERLOCKING JAW POWER TONGS

[76] Inventor: David A. Buck, 1348 Sawmill Hwy., Breaux Bridge, La. 70517

[21] Appl. No.: 728,761

[22] Filed: Oct. 11, 1996

[51] Int. Cl.[6] ..... B25B 13/50

[52] U.S. Cl. ..... 81/57.18; 81/57.2; 81/57.21

[58] Field of Search ..... 81/57.15, 57.16, 81/57.18, 57.2, 57.21, 57.33, 57.34

[56] References Cited

U.S. PATENT DOCUMENTS

| | | | |
|---|---|---|---|
| 2,544,639 | 3/1951 | Calhoun | 255/35 |
| 3,799,009 | 3/1974 | Guier | 81/57.2 X |
| 4,084,453 | 4/1978 | Eckel | 81/57.18 |
| 4,089,240 | 5/1978 | Eckel | 81/57.18 |
| 4,404,876 | 9/1983 | Eckel | 81/57.18 |
| 4,546,681 | 10/1985 | Owsen | 82/38 |
| 4,631,987 | 12/1986 | Buck | 81/57.14 |
| 4,709,599 | 12/1987 | Buck | 81/57.18 |
| 4,759,239 | 7/1988 | Hamilton et al. | 81/57.34 |
| 4,811,635 | 3/1989 | Falgout, Sr. | 81/57.33 |
| 5,150,642 | 9/1992 | Moody et al. | 81/57.2 |
| 5,291,808 | 3/1994 | Buck | 81/57.18 |
| 5,542,318 | 8/1996 | Wesch, Jr. | 81/57.33 |

*Primary Examiner*—D. S. Meislin
*Attorney, Agent, or Firm*—Roy, Kiesel & Tucker

[57] ABSTRACT

The present invention provides an improved power tong with a body having a rotating assembly. The power tong further has a plurality of jaw members positioned within the rotating assembly with two of the jaw members being pivoting jaws adapted to interlock when in a closed position. In an alternate embodiment, the improved power tong will have a compensating jaw assemble to limit the axial load placed on the tubular member being gripped.

18 Claims, 3 Drawing Sheets

INTERLOCKING JAW POWER TONGS

BACKGROUND OF INVENTION

The present invention relates to power tongs typically used in the oil and gas industry to make up and break apart threaded joints on pipe, casing and similar tubular members.

Power tongs have been in existence for many years and are generally employed in the oil and gas industry to grip and rotate tubular members, such as drill pipe. It is necessary to grip drill pipe with high compressive forces while applying a high degree of torque in order to break apart or tighten threaded pipe connections. In most cases, power tong designs employ a cam mechanism for converting a portion of the torque into a gripping (compressive) force normal to the pipe. This conversion is often accomplished utilizing a power-driven ring gear having an interior cam surface. A cam follower (roller) on a jaw member rides upon the cam surface. As the ring gear is rotated, the follower (and thus the jaw member) is urged into contact with the pipe. An example of such an arrangement can be seen in U.S. Pat. No. 4,404,876.

Most current power tong designs include a ring gear camming member with an open slot or throat, through which the drill pipe is passed in order to place the power tong in position around the pipe. Some tong designs employ a ring gear camming member which has no open throat and is thus a solid circular member. However, a power tong with a solid ring gear camming member must be employed by passing it over the end of a pipe because there is no open throat to facilitate installation. A power tong with a solid ring gear must be left in place around the pipe until conditions permit removal by sliding the tong off one end of the pipe.

Due to the tremendous forces generated during use, open throat power tongs must resist spreading during use. Prior art open throat tongs employ heavy duty rollers and other support structure to resist spreading. Despite such precautions, prior art tongs often spread and fail during use, resulting in tremendous costs and down time during expensive drilling operations. While power tongs having solid circular camming members do not have the spreading problem, the versatility of open throat designs is much preferred.

Another problem often encountered with power tongs using a rotating cam surface to grip the tubular member is that the axial on the tubular member is proportional to the torque. Therefore in applications where high torque forces are needed, these types of power tongs may transmit such a high axial load to the tubular member that the tubular member is damaged or rendered unusable.

OBJECTS AND SUMMARY OF THE INVENTION

It is therefore an object of this invention to provide a power tongs tool which does not subject the ring gear to spreading forces.

It is another object of this invention to provide a manner of limiting the axial load on a tubular member when high torque forces are required.

Therefore the present invention provides an improved power tong with a body having a rotating assembly. The power tong further has a plurality of jaw members positioned within the rotating assembly with two of the jaw members being pivoting jaws adapted to interlock when in a closed position. In an alternate embodiment, the improved power tong will have a compensating jaw assemble to limit the axial load placed on the tubular member being gripped.

DETAILED DESCRIPTION

Figure 1:
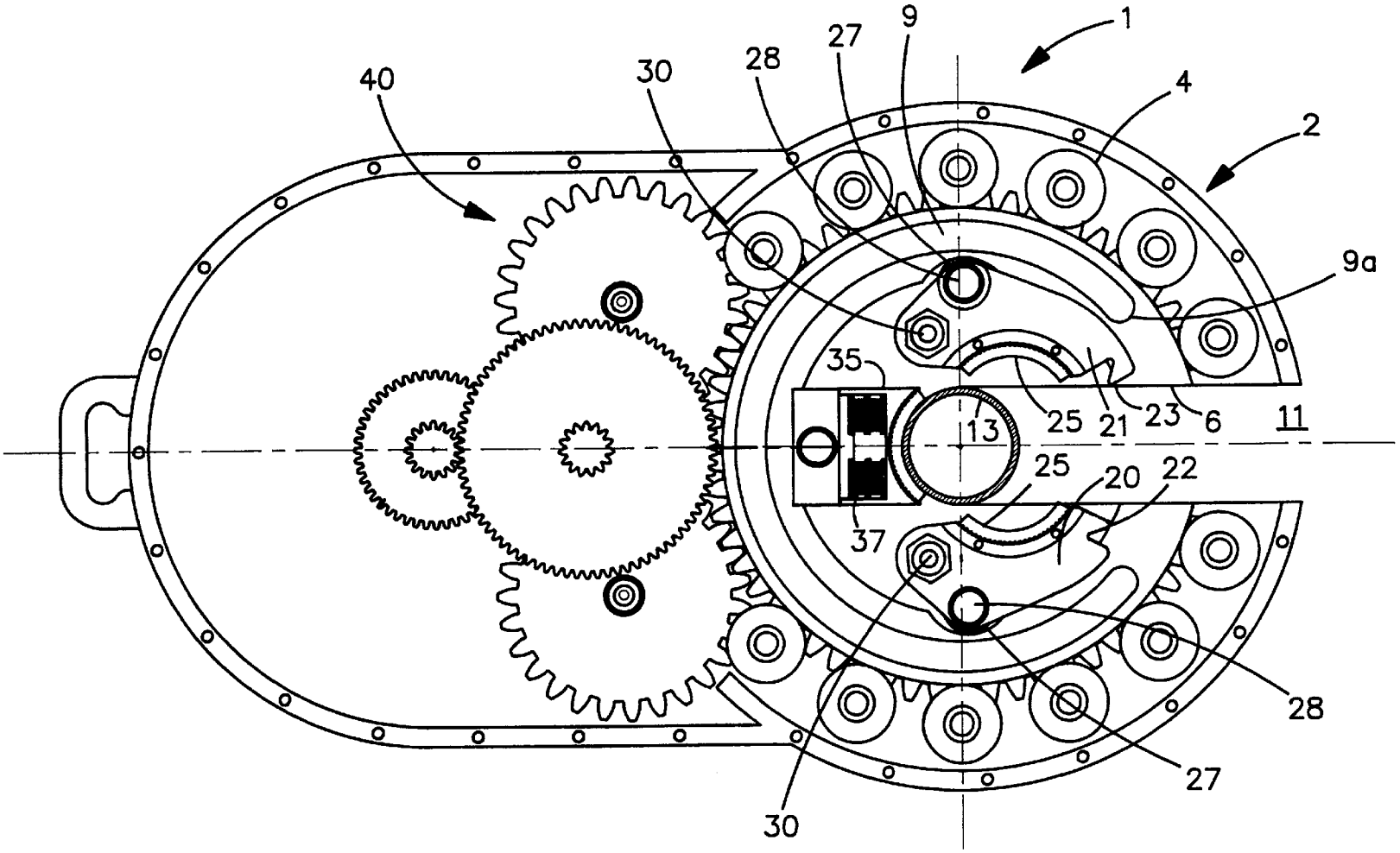
FIG. 1 is a top view of the present invention with the top cage plate removed showing the jaw members in an open position.

FIG. 1 illustrates one preferred embodiment of the present invention. Power tong 1 is of the type having an open throat 11. FIG. 1 shows power tong 1 with the cover plate and cage plate removed in order to show the main internal components positioned within frame 2 of power tong 1. Frame 2 contains a series of rollers 4 running along the inner periphery of front end 3 of frame 2. Ring gear 6 is positioned between and supported by rollers 4 such that ring gear 6 may rotate within frame 2. The outer periphery of ring gear 6 will have a series of gear teeth 7 positioned thereon. Drive 7 will engage the cogs of drive train 40 in order to impart torque to ring gear 6. Drive train 40 is a conventional drive mechanism well known in the art. The inner periphery of ring gear 6 will also have a plurality of cam surfaces formed thereon which will operate to open and close jaws 20, 21 and 35, the function of which will be explained in greater detail below. As best seen in the perspective view of FIG. 3, ring gear 6 will further have channel 9 formed on its upper and lower surfaces. Channel 9 is sized to engage roller bearings 45 which can be seen on lower cage plate 16. While hidden from view in FIG. 3, identical roller bearings 45 are positioned on upper cage plate 15. It will be understood that when ring gear 6 is assembled in power tong 1 between upper and lower cage plates 15 and 16, ring gear 6 is able to rotate relative to cage plates 15 and 16 on roller bearing 45. However, while ring gear 6 is able to rotate between cage plates 15 and 16, the degree of rotation is limited. As ring gear 6 continues to rotate relative to cages plates 15 and 16, the end 9*a* of channel 9 will engage stop pins 43 on both the upper and lower cages plates 15 and 16, whereupon relative movement between ring gear 6 and cage plates 15 and 16 will cease. While the stop pins 43 on cage plate 15 are hidden from view, they will occupy the same position as stop pins 43 on cage plate 16. The roll relative movement between ring gear 6 and cage plates 15 and 16 play in the power tongs function will be explained in greater detail below. In the embodiment shown, top and bottom cage plates 15 and 16 along with ring gear 6 will generally comprise a rotative assembly in which will rotate jaws 20, 21, and 35 in order to apply torque to tubular member 13. However, the rotative assembly could be comprised of any group of parts that supply rotary motion necessary to generate torque.

Returning now to FIG. 1, positioned within ring gear 6 are two pivoting jaws 20 and 21 and an axial jaw 35. Pivoting jaws 20 and 21 are substantially identical excepting for their respective locking hooks 22 and 23. Locking hooks 22 and 23 are merely one preferred embodiment for interlocking pivoting jaws 20 and 21 and all conventional methods of interlocking the pivoting jaws are considered within the scope of this invention. Similarly, while not shown in the figures, the scope of the present invention is also intended to include pivoting jaws without locking hooks. Pivoting jaws 20 and 21 will be pivotally attached between top cage plate 15 and bottom cage plate 16 by pivot pin 30. Pivoting jaws 20 and 21 further include cam followers 27 which will be pinned in place by follower pins 28 such that cam followers may freely rotate on follower pins 28. It will be understood that the pivoting jaws are assembled inside of ring gear 6 and between cage plates 15 and 16 and pivoting jaws 20 and 21 will be free to pivot on pins 30 toward and away form the center point of power tongs 1. The side of pivoting jaws 20 and 21 which face tubular member 13 will have die inserts 25 which will provide the actual gripping surface for securely holding tubular member 13 against the high torque loads that will be encountered. An example one suitable die insert 25 is seen in U.S. Pat. No. 4,576,067 to David Buck, which is incorporated by reference herein. Another suitable die insert 25 is seen in a pending application to Daniel Bangert filed on Sep. 13, 1996. The embodiment shown also includes a third jaw member 35. Axial jaw 35 has a cam follower 27 and follower pin 28 as do pivoting jaws 20 and 21. However axial jaw 35 is not pinned to cage plates 15 and 16, but may move axially to engage tubular member 13. Axial jaw 35 further comprises a load compensating device 37 which will be explained in greater detail below. Like pivoting jaws 20 and 21, axial jaw 35 will be provided with a die insert 25 with which to engage the tubular member 13.

Figure 2:
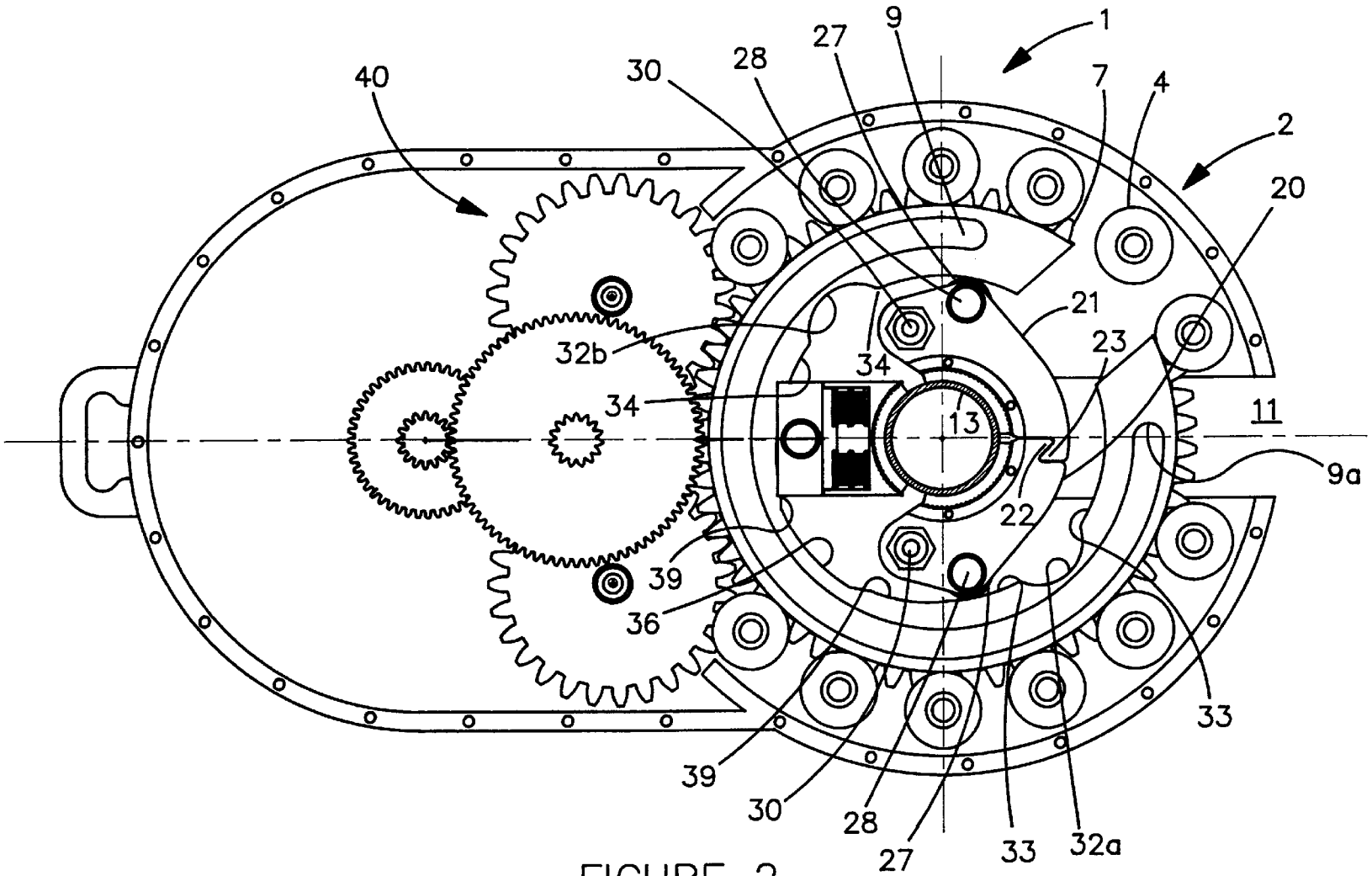
FIG. 2 is a top view of the present invention with the top cage plate removed showing the jaw members in a closed position.

The mechanism for opening and closing the jaws 20, 21, and 35 is provided by relative movement of the cam surfaces on ring gear 6 and the cam followers 27 on each of the jaws. As best seen in FIG. 2, ring gear 6 has a neutral cam surface for each jaw member and cam surfaces formed on each side of the neutral surfaces. The indentions 32*a* and 32*b* seen in ring gear 6 are the neutral surfaces for pivoting jaws 20 and 21 and the longer, less pronounced indention 36 is the neutral surface for axial jaw 35. Cam surface 33 will be formed on either side of neutral surface 32*a*, cam surface 34 on either side of neutral surface 32*b*, and cam surface 39 and either side of neutral surface 36. When the cam followers 27 engage neutral surfaces 32*a* and 32*b*, the pivoting jaws 20 and 21 can spread to the open position (as best seen in FIG. 1). Similarly, when the cam follower of axial jaw 35 engages neutral surface 36, axial jaw 35 may be moved away from tubular 13. Springs or other conventional biasing mechanisms will be used to bias the jaws in the open position whenever the cam followers are on a neutral surface. However, when it is desired to close the jaws, ring gear 6 can be rotated in either direction, forcing the cam followers onto the cam surfaces 33 and 34 for pivoting jaws 20 and 21 and cam surface 39 for axial jaw 35. As cam followers 27 on pivoting jaws 20 and 21 transition from neutral surfaces to cam surfaces, the cam followers move toward the center point of power tongs 1, causing jaws 20 and 21 to pivot toward a closed position.

In order for jaws 20, 21, and 35 to properly grip tubular member 13, it is necessary for the jaws to close in a certain sequence. In the embodiment shown, jaw hook 22 of pivoting jaw 20 must close on the tubular member 13 slightly sooner than jaw hook 23 of pivoting jaw 21 in order for the jaw hooks to be properly engaged. Additionally, jaw hooks 22 and 23 should be locked prior to axial jaw 35 closing on tubular member 13 and forcing tubular member 13 against pivoting jaws 20 and 21. This sequence of jaw closings is effected by the positioning of the cam surfaces on ring gear 6.

Thus neutral surface 32*a* transitions into cam surface 33 slightly sooner than neutral surface 32*b* transitions into cam surface 34, thereby causing pivoting jaw 20 to close slightly ahead of pivoting jaw 21. However, to insure the axial jaw does not engage tubular member 13 prior to the pivoting jaws locking, neutral surface 36 is comparatively long, allowing ring gear 6 to rotate some distance before transitioning to cam surface 39. At the point cam follower 27 of axial jaw 35 engages cam surface 39 and closes on tubular member 13, pivoting jaws 20 and 21 will be securely locked.

As mentioned above, axial jaw 35 will include a compensating device that will limit the load axial jaw 35 transmits to tubular member 13. Generally, the axial load on tubular member 13 increases proportionately with the torque that is being applied by power tongs 1. There may be instances where the high torque loads needed to break apart a pipe joint may generate an axial load sufficient to crush or damage the tubular member 13. Therefore a compensating system may be needed to insure excessively high torque loads do not transmit to the tubular member excessive axial loads. Compensating device 37 may comprise a spring or any other resilient type device. After axial jaw 35 has engaged the tubular member 13 and the torque load begins to increase, the axial force on the tubular member 13 also begins to increase. Compensating device 37 is designed to allow an axial load to be transmitted to the tubular member 13 which is sufficient to embed the serrations or gripping surface of the die insert into the outer skin of the tubular member 13. However, as the torque load rises, compensating device 35 will begin to absorb the excess axial load being generated. In this manner, the torque loads necessary to break apart the tubular member 13 joint may be reached without damaging axial loads being imparted to the tubular member 13.

Figure 3:
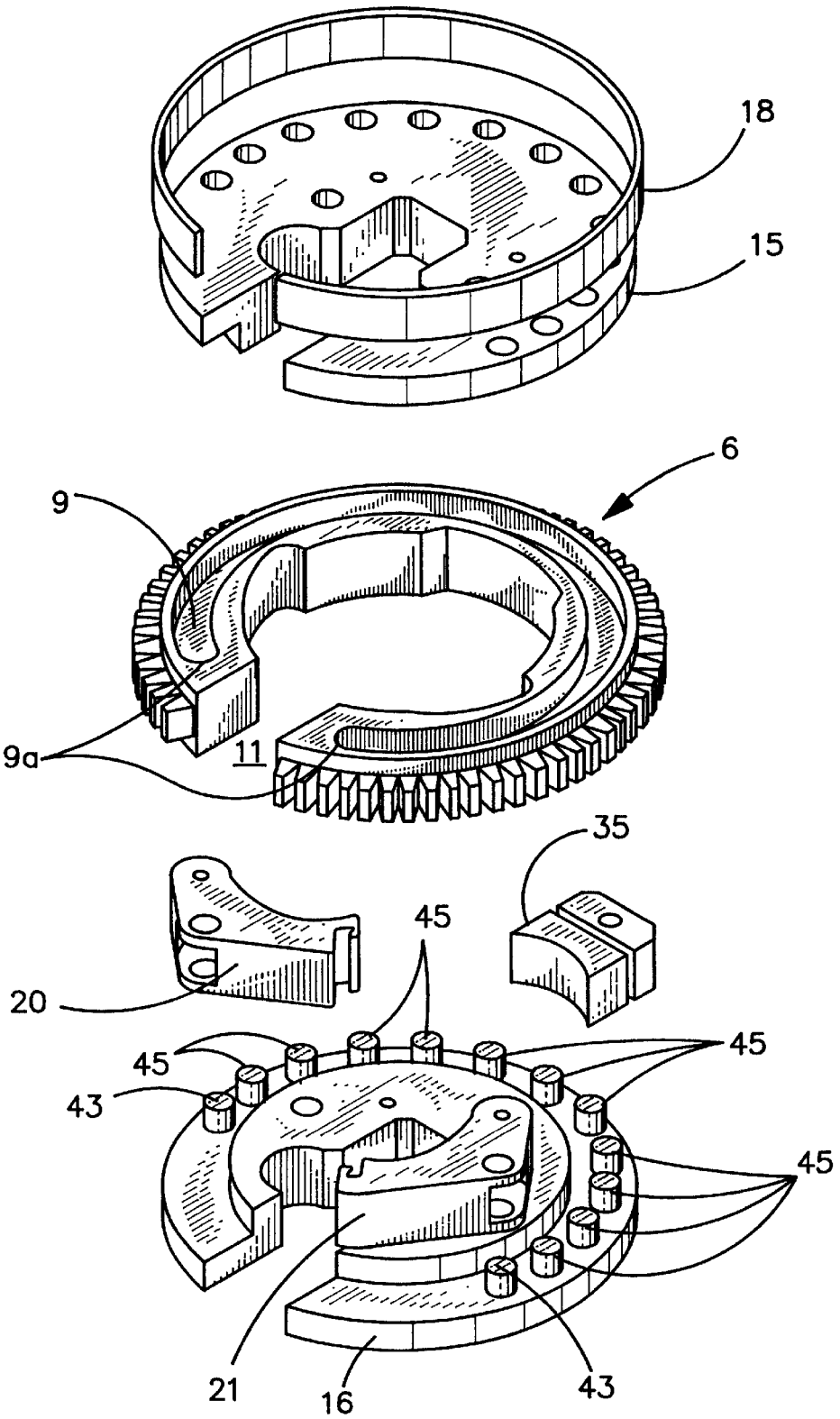
FIG. 3 is an exploded perspective view of the cage plates, jaws and ring gear of the present invention.

When back-up power tongs 1 are put into operation, the jaws of the tongs 1 will initially be in the open position as shown in FIG. 1. Tongs 1 will then be positioned such that tubular member 13 moves through throat 11 of tongs 1 and is adjacent to axial jaw 35. To grip the tubular member 13, power is supplied to drive train 40 which engages teeth 7 and begins to rotate ring gear 6. Initially, upper and lower cage plates 15 and 16 do not rotate with ring gear 6 because the cage plates are held in place by a conventional brake band. As is well known in the art, the brake band will be positioned on the body of the power tong encircling upper cage plate 15. While not shown attached to the tong body, FIG. 3 illustrates conceptually brake band 18's relationship to top cage plate 15. The brake band 18 will frictionally resist the initial torque imparted to the cage plates and remain stationary with respect to ring gear 6. Since pivoting jaws 20 and 21 are attached to cage plates 15 and 16, the pivoting jaws also initially remain stationary with respect to ring gear 6. The initial rotation of ring 6 (seen rotating counterclockwise in FIG. 2), causes the cam surfaces 34 and 33 to engage the cam followers of pivoting jaws 21 and 20 respectively. However, because neutral surface 26 on which axial jaw 35 travels is longer than the neutral surfaces related to the pivoting jaws, axial jaw 35 does not initially close with pivoting jaws 20 and 21. After pivoting jaws 20 and 21 have locked and ring gear 6 continues its rotation, cam follower 27 of axial jaw 35 passes neutral surface 36 and engages cam surface 39. At this point axial jaw 35 will begin to engage tubular member 13 and force tubular 13 in to a securely gripped position between jaws 20, 21, and 35.

As ring gear 6 continues to rotate, end 9*a* of cage plate channel 9 comes into contact with stop pin 43. The force exerted on cages plates 15 and 16 by ring gear 6 now overcomes the retaining force of the brake band 18 and cage plates 15 and 16 rotate as a unit with ring gear 6. As cage plates 15 and 16 begin to rotate, jaws 20, 21, and 35 also rotate and apply torque to the tubular member 13. Ring gear 6 will continue to be rotated until the tubular joint in question is broken down. It will be understood that the operation shown by FIG. 2 is rotating the tubular member 13 in the counter clockwise direction to beak apart the threaded joint on the tubular member 13. All cam surfaces described herein are symmetrical and the exact same operation takes place in the clockwise direction when making up tubular joints.

Viewing FIG. 2, the significant advantages of the present invention over the prior art will become apparent. In the prior art, the reactionary forces from the axial load on the tubular member 13 causes serious difficulties by the spreading apart of open throated ring gears. Because the present invention interlocks the pivoting jaws 20 and 21, the spreading forces are transmitted to the pivot pins 30 and cage plates 15 and 16 rather than the cam followers 27 and ring gear 6. Therefore the present invention eliminates spreading forces on the ring gear 6.

Finally, while many parts of the present invention have been described in terms of specific embodiments, it is anticipated that still further alterations and modifications thereof will no doubt become apparent to those skilled in the art. It is therefore intended that the following claims be interpreted as covering all such alterations and modifications as fall within the true spirit and scope of the invention.

I claim:

1. An apparatus for applying torque to tubular members comprising:

(a) a body having a rotating assembly with a center opening adapted to receive a tubular member;

(b) a plurality of jaws positioned within said rotating assembly;

(c) said jaws including first and second pivoting jaws, said first pivoting jaw having a locking surface adapted to interlock with a locking surface on said second pivoting jaw when said pivoting jaws are in a closed position; and (d) said rotating assembly further including a cage plate and a ring gear, whereby relative movement between said cage plate and said ring gear pivots said pivoting jaws.

2. The apparatus according to claim 1, wherein both of said pivoting jaws have a gripping surface for holding a tubular member against rotation when said pivoting jaws are in a closed position around said center opening.

3. An apparatus according to claim 1, wherein said ring gear includes a cam surface and said cam surface operates to close said pivoting jaws.

4. The apparatus according to claim 1, wherein one of said plurality of jaws is a nonpivoting axial jaw movable in an axial direction toward said center opening.

5. The apparatus according to claim 1, wherein said rotating assembly includes a cam surface and said pivoting jaws engage said cam surface in order to close.

6. The apparatus according to claim 4, wherein said ring gear has formed thereon first cam surfaces for engagement with said pivoting jaws and a second cam surface for engagement with said axial jaw, said first cam surfaces spaced to engage said pivoting jaws prior to said second cam surface engaging said axial jaw whereby causing said pivoting jaws to reach a closed position prior to said axial jaw reaching a closed position.

7. The apparatus according to claim 1, wherein said apparatus has first and second pivoting jaws and said ring gear has first and second cam surfaces corresponding with said first and second pivoting jaws, said first cam surface being spaced on said ring gear such that said first pivoting jaw closes prior to said second pivoting jaw closing.

8. The apparatus according to claim 4, wherein said axial jaw includes a compensating device limiting the load said axial jaw can transfer to a tubular member.

9. An apparatus according to claim 6, wherein said cam surfaces further comprise a neutral cam surface allowing said jaws to remain in an open position and a positive cam surface causing said jaws to move into a closed position.

10. An apparatus according to claim 6, wherein said body has a hydraulic motor and a gear train for transferring torque from said motor to said ring gear of said rotative assembly.

11. An apparatus according to claim 10, wherein a brake band applies frictional resistance to said cage plate in order to induce relative movement between said cage plate and said ring gear.

12. An apparatus according to claim 7, wherein said locking surfaces further comprise locking hooks.

13. An apparatus for applying torque to tubular members comprising:

(a) a body having a rotating means;

(b) a gripping means positioned in said rotating means, said gripping means having two jaw components moving in a pivotal path to engage the tubular member;

(c) said jaw components having attached thereto a means for locking said jaw components together; and (d) said rotating means further including a cage plate and a ring gear, whereby relative movement between said cage plate and said ring gear pivots said jaw components in said pivotal path.

14. An apparatus for applying torque to tubular members comprising:

(a) a body having a rotating assembly with a center opening for receiving a tubular member, said rotating assembly further including a ring gear having a first and second cam surface formed thereon;

(b) a pivoting jaw positioned within said rotating assembly so as to engage said first cam surface;

(c) a nonpivoting axial jaw positioned in said rotating assembly so as to engage said second cam surface, said axial jaw moving in an axial direction toward said center opening.

15. An apparatus according to claim 14, further having a second pivoting jaw.

16. An apparatus according to claim 14, wherein said rotating assembly has a cage plate and said pivoting jaw is pivotally attached thereto.

17. An apparatus according to claim 15, wherein said pivoting jaws have locking surfaces formed thereon.

18. An apparatus according to claim 1, wherein said locking surfaces further comprise locking hooks.

* * * * *